US009670701B2

(12) United States Patent
Okawa et al.

(10) Patent No.: US 9,670,701 B2
(45) Date of Patent: Jun. 6, 2017

(54) MOTOR-VEHICLE DOOR LATCH DEVICE

(71) Applicant: MITSUI KINZOKU ACT COPORATION, Yokohama-shi, Kanagawa (JP)

(72) Inventors: Shintaro Okawa, Yokohama (JP); Shigekazu Sugo, Yokohama (JP)

(73) Assignee: Mitsui Kinzoku Act Corporation, Yokohama-shi (JP)

( * ) Notice: Subject to any disclaimer, the term of this patent is extended or adjusted under 35 U.S.C. 154(b) by 449 days.

(21) Appl. No.: 14/449,455

(22) Filed: Aug. 1, 2014

(65) Prior Publication Data

US 2015/0042108 A1 Feb. 12, 2015

(30) Foreign Application Priority Data

Aug. 7, 2013 (JP) ..... 2013-163764

(51) Int. Cl.

| | |
|---|---|
| ***E05C 3/06*** | (2006.01) |
| ***E05B 81/14*** | (2014.01) |
| *E05C 3/16* | (2006.01) |
| *E05B 81/06* | (2014.01) |

(52) U.S. Cl.

CPC ..... *E05B 81/15* (2013.01); *E05B 81/06* (2013.01); *Y10S 292/04* (2013.01); *Y10T 292/1043* (2015.04)

(58) Field of Classification Search

CPC ..... E05B 81/15; Y10S 292/04
USPC ..... 292/194, 216
See application file for complete search history.

(56) References Cited

U.S. PATENT DOCUMENTS

| | | | | |
|---|---|---|---|---|
| 4,334,704 | A * | 6/1982 | Yamada | E05B 79/12 292/216 |
| 5,738,393 | A * | 4/1998 | Chao | E05B 83/24 292/216 |
| 5,897,148 | A * | 4/1999 | Arabia, Jr. | E05B 85/243 292/209 |
| 8,348,310 | B2 * | 1/2013 | Vazquez | E05B 85/26 292/216 |
| 9,359,796 | B2 * | 6/2016 | Betzen | E05B 81/40 |
| 2002/0121786 | A1 * | 9/2002 | Meinke | E05B 85/107 292/347 |
| 2003/0160461 | A1 * | 8/2003 | Promutico | D06F 37/42 292/216 |
| 2006/0186677 | A1 * | 8/2006 | Bella | E05B 77/06 292/304 |
| 2007/0029814 | A1 * | 2/2007 | Coleman | E05B 81/14 292/201 |

(Continued)

FOREIGN PATENT DOCUMENTS

| | | | |
|---|---|---|---|
| DE | 102008032758 | * | 1/2016 |
| JP | 3143586 | B2 | 11/1997 |
| JP | 2001-329731 | A1 | 11/2001 |

*Primary Examiner* — Carlos Lugo
(74) *Attorney, Agent, or Firm* — Davis & Bujold PLLC; Michael J. Bujold

(57) ABSTRACT

In a motor-vehicle door latch device, a latch engages with a striker of a vehicle body when a door is closed. The latch comprises a half-latch engaging portion for incompletely engaging the latch with the striker and a full-latch engaging portion for fully engaging the latch with the striker. A half-latch avoiding member has a half-latch avoiding guide path which engages with a connecting member, thereby preventing the engagement member from engaging the half-latch portion of the latch.

5 Claims, 8 Drawing Sheets

(56) References Cited

U.S. PATENT DOCUMENTS

2010/0045049 A1* 2/2010 Persiani ..... B60K 15/05
292/14

* cited by examiner

OPEN STATE

HALF-LATCH POSITION

FULL-LATCH POSITION

FULL-LATCH STATE

OPENING ACTION

HALF-LATCH POSITION

JUST BEFORE OPEN POSITION

OPEN POSITION

FULL-LATCH STATE

OPENING ACTION

OPEN POSITION

HALF-LATCH POSITION

MOTOR-VEHICLE DOOR LATCH DEVICE

BACKGROUND OF THE INVENTION

The present invention relates to a motor-vehicle door latch device.

A door latch device in a motor vehicle comprises a latch that is mounted via a shaft to a base member fixed to a liftgate and disengages from a striker of a vehicle body from a full-latch position where the liftgate is fully closed to an open position; an engagement member such as a pawl or a ratchet that engages a full-latch engaging portion of the latch to hold the latch in the full-latch position; and a releasing lever actuated with a door-opening unit to turn the engagement member to disengage the engagement member from the full-latch engaging portion.

In the door latch device, a half-latch position is set in which even if the latch should be disengaged from the engagement member when the latch is in the full-latch position, the door is held in a incompletely-closed state by engaging the engagement member with a half-latch engaging portion between the full-latch position and the open position so as not to open the liftgate accidentally.

In the door latch device in which the half-latch position is set, for example, when the liftgate is opened and closed by a switch for an electric actuator for opening the door and a lever for opening the door in a driver's seat, the engagement member engages with the half-latch engaging portion in the half-latch position to hold the liftgate in a half-open state due to lack in raising of the liftgate because repulsion of a weatherstrip decreases or the circumference around the liftgate is frozen, the liftgate cannot be opened by a single opening action.

It is necessary to disengage the latch from the engagement member by operating the switch or lever again, which is troublesome.

JP2001-329731A and JP3143586B2 disclose a door latch device and a door lock device respectively for overcoming the foregoing disadvantage.

In the door latch device in JP2001-329731A, when the opening lever is actuated to open the door, the pawl is turned by the opening lever in a direction for disengaging from the latch. When the opening lever is operated to the releasing end of the door, a holding lever engages with the opening lever, and the pawl is held in a position where the pawl does not engage with the half-latch engaging portion and full-latch engaging portion.

In the door lock device in JP3143586B2, a half-latch preventing plate has an arcuate projection around the latch shaft, and the ratchet has a projection-having half-preventing lever which moves with the ratchet when the ratchet disengages from a full-latch engagement step by opening the door. When the door is opened, the half-latch engagement step does not engage with the ratchet so that the projection on the projection-having half-preventing lever does not return beyond the arcuate projection.

In the door latch device in which the half-latch position is set, when the door is closed, the engagement member engages with the half-latch engaging portion due to repulsion of a weatherstrip, and the door is incompletely closed. The liftgate cannot be closed by a single door-closing action.

In view of the disadvantage, there are a door-opening half-latch avoiding unit for preventing the latch from being held in the half-latch position when the door is opened, and a door-closing half-latch avoiding unit for preventing the latch from being held in the half-latch position when the door is closed. The two units are selectively installed to provide a door latch device for preventing the latch from being held in the half-latch position when the door is closed, and a door latch device for preventing the latch from being held in the half-latch position when the door is opened. One of the two door latch devices can readily be provided depending on demand of customers.

However, in order to apply the door latch device and the door lock device in JP2001-329731A and JP3143586B2 respectively to a door latch device for preventing the latch from being held in the half-latch position when the door is closed, it is necessary to change and modify the shape and position of each element.

SUMMARY OF THE INVENTION

In view of the disadvantage, it is an object of the invention to provide a motor-vehicle door latch device providing a door latch device for preventing a latch from being held in a half-latch position when a door is closed and a door latch device for preventing the latch from being held in the half-latch position when the door is opened.

DETAILED DESCRIPTION OF PREFERRED EMBODIMENTS

Figure 2:
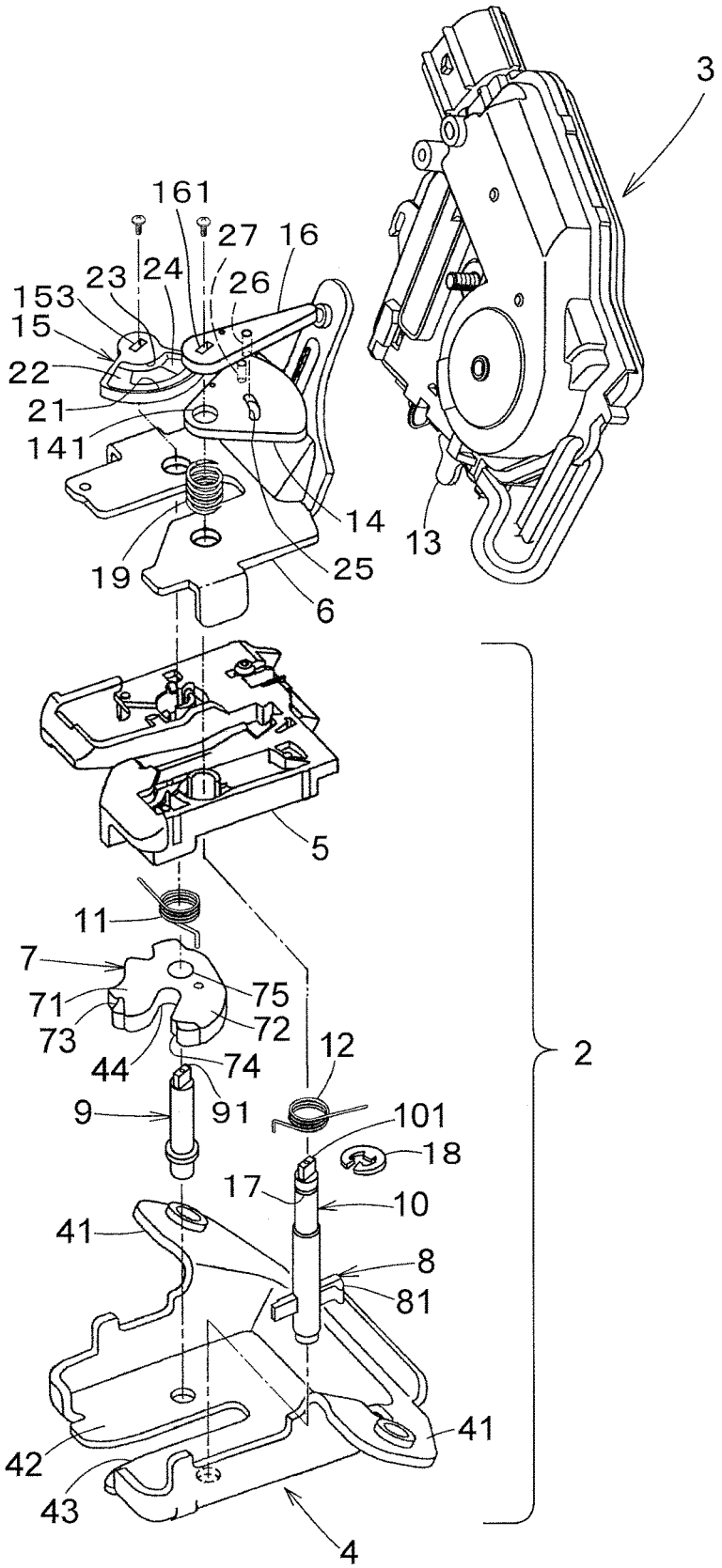
FIG. 2 is an exploded perspective view of the door latch device.
Figure 3:
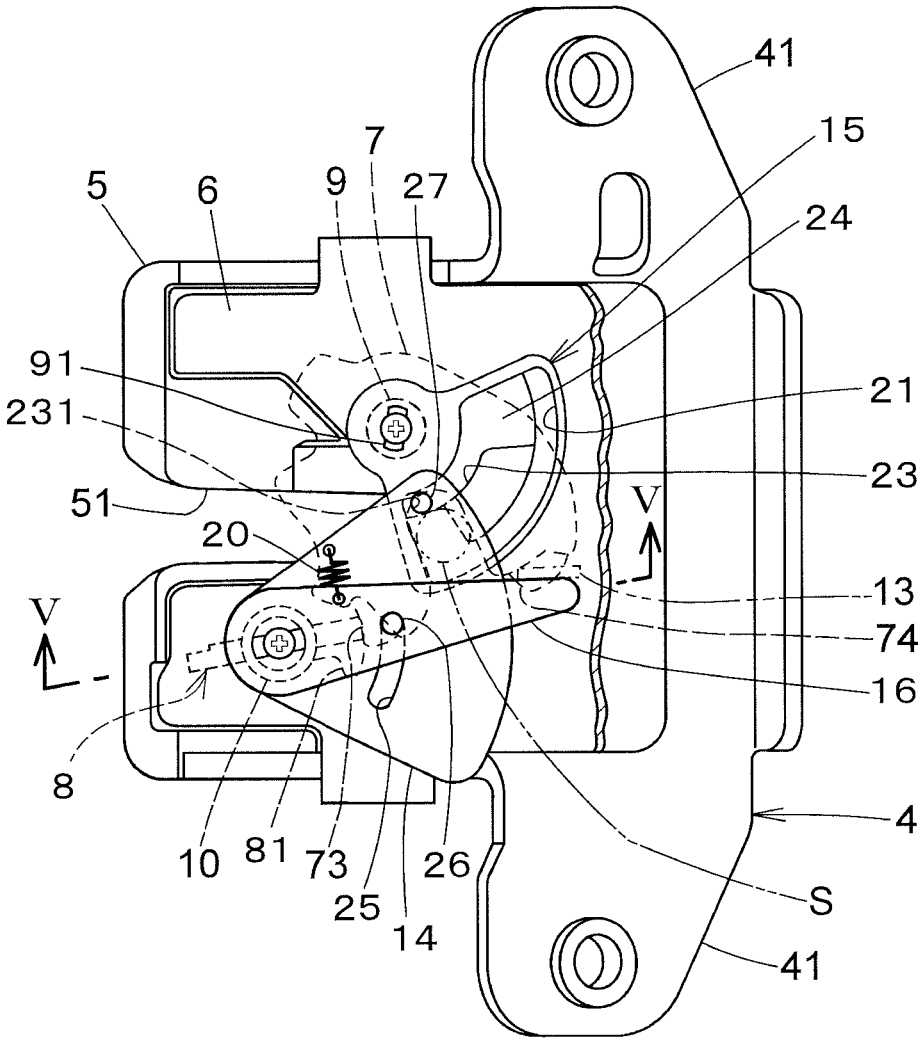
FIG. 3 is a partially cut-away plan view of a latch mechanism of the door latch device viewed in a direction of an arrow III in FIG. 1.
Figure 4:
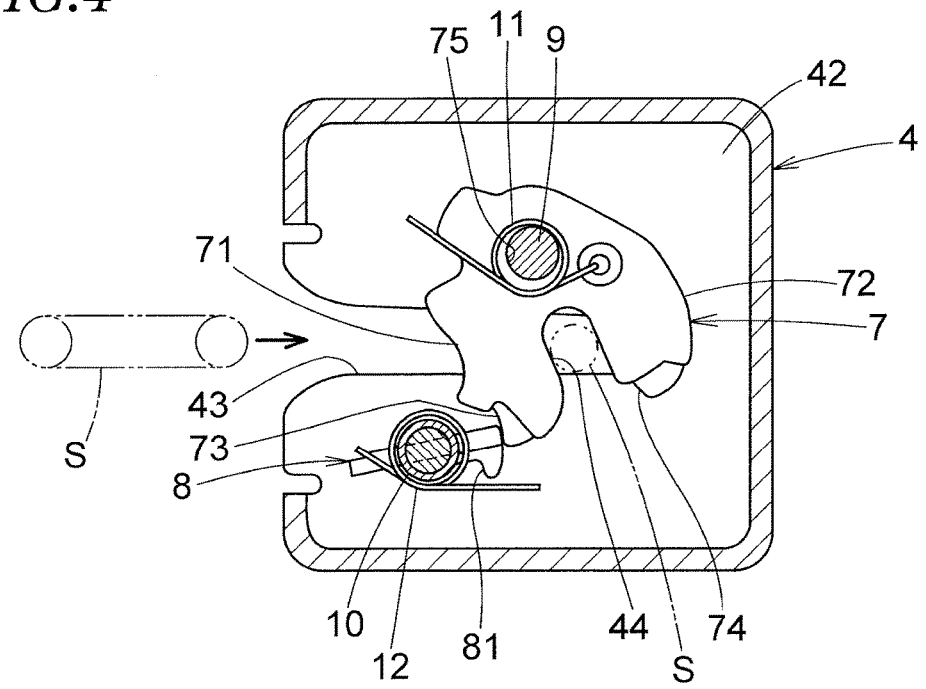
FIG. 4 is a horizontal sectional view taken along the line IV-IV in FIG. 1.

A first embodiment of a door latch device according to the present invention will be described, in which a door latch is prevented from being held in a half-latch position when a door is closed, with respect to the drawings. In the following description, a left side and a right side in FIGS. 1 and 2 are deemed as a front and a back of a motor vehicle respectively, and a top and a bottom in FIGS. 3 and 4 are deemed as "a right side" and "a left side" of the motor vehicle respectively.

Figure 1:
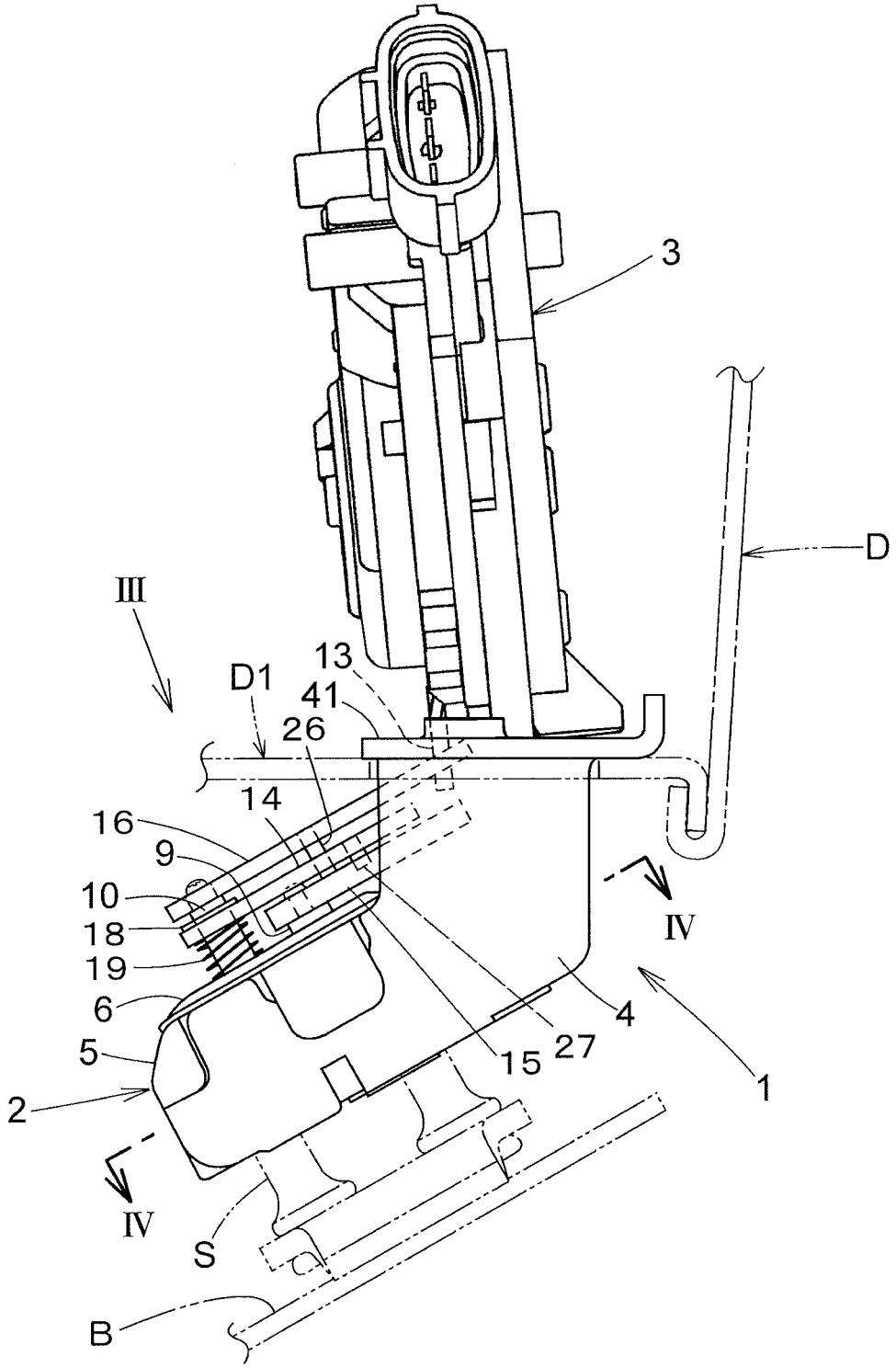
FIG. 1 is a side elevational view of a door latch device according to the present invention attached to a liftgate, the door latch device preventing a latch from being held in a half-latch position.

In FIG. 1, the door latch device 1 in this embodiment is applied to a liftgate D pivotally mounted up and down at the back part of a vehicle body B of the motor vehicle. The door latch device 1 is mounted to a approximately horizontal lower panel D1 of the liftgate D, and comprises a latch mechanism 2 that can engage with a striker S fixed to the vehicle body B and an electric actuator 3 acting by opening the door.

In FIGS. 2 to 5, the latch mechanism 2 comprises a metal base member 4 having an upper opening; a synthetic-resin cover 5 covering the upper opening of the base member 4; and a metal bracket 6 fixed to an upper surface of the cover member 5. Outward flanges 41,41 are fixed to a lower panel D1 of the door D with a bolt (not shown). In the middle of a bottom plate 42 of the base member 4 and the cover member 5, there are formed striker-fitting grooves 43,51 into which the striker S fits when the door D is closed.

The latch mechanism 2 comprises a latch 7 disposed in a space between the base member 4 and the cover member 5 to pivot with a vertical latch shaft 9 to engage with the striker S; and a pawl 8 that can engage with the latch 7.

A lower part of a latch shaft 9 pivotally mounted to the base member 4, the cover member 5 and a bracket 6 is pressingly fitted into an axial hole 75 of the latch 7. Thus, the latch 7 pivots with the latch shaft 9. The latch 7 rotates with the latch shaft 9 clockwise or counterclockwise between an open position in which the striker S is released when the door is open, and a full-latch position in which the latch 7 fully engages with the striker S when the door is fully closed.

The pawl 8 rotates with a pawl shaft 10 between the base member 4 and the cover member 5. The latch shaft 9 and the pawl shaft 10 pass through the bracket 6 and project upward.

In FIG. 4, the latch 7 comprises a front arm 71 and a rear arm 72 facing each other. At the ends of the front arm 71 and the rear arm 72, there are formed a full-latch engaging portion 73 and a half-latch engaging portion 74 capable of engaging with a pawl portion 81 of the pawl 8. The latch 7 is molded with resin except the full-latch engaging portion 73 and the half-latch engaging portion 74.

Between the front arm 71 and the rear arm 72, there is formed a U-shaped striker-fitting groove 44 that can engage with the striker S in the striker-fitting grooves 43,51. The pawl portion 81 of the pawl 8 pivots with the pawl shaft 10 between an engagement position in which the pawl portion 81 engages with the full-latch engaging portion 73 or the half-latch engaging portion 74 in FIG. 4 and a releasing position the full-latch engaging portion 73 or half-latch engaging portion 74 is released where the latch 7 pivots clockwise by a certain angle from FIG. 4.

When the door D is closed, the striker S comes into the striker-fitting groove 44 of the latch 7, which turns counterclockwise. The striker S fits in the striker-fitting groove 44, and the pawl portion 81 of the pawl 8 engages with the full-latch engaging portion 73, so that the latch 7 is held in the full-latch position in FIGS. 3 and 4.

Figure 5:
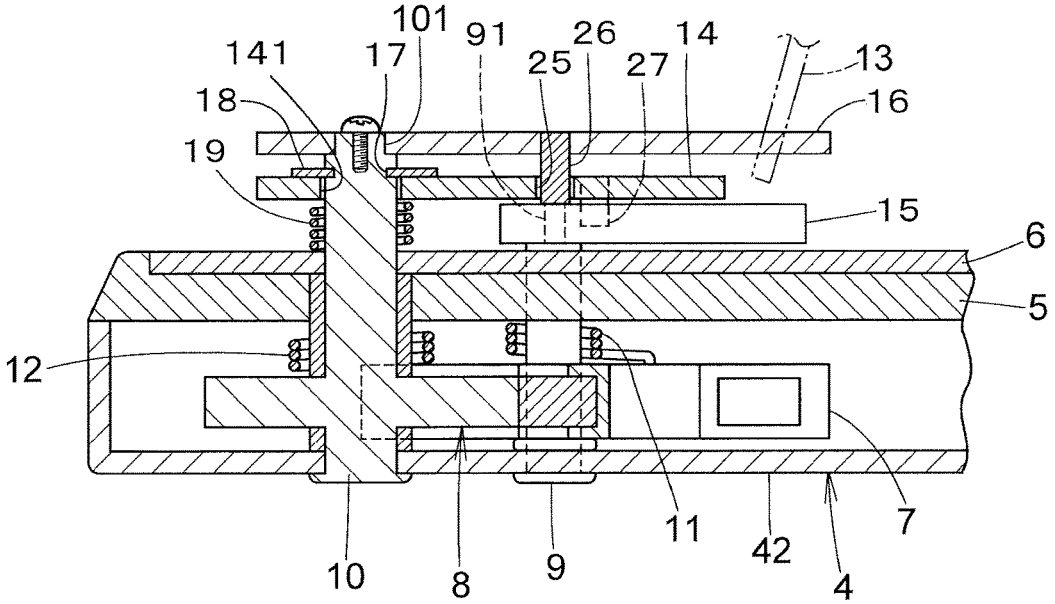
FIG. 5 is an enlarged vertical sectional view taken along the line V-V in FIG. 3.

In FIGS. 4 and 5, a torsion spring 11 is wound on the latch shaft 9, and a torsion spring 12 is wound on the pawl shaft 10 between the base member 4 and the cover member 5. The latch 7 is biased clockwise by the torsion spring 11 in a direction for releasing the striker S. The pawl 8 is biased counterclockwise by the torsion spring 12 in a direction for engaging with the full-latch engaging portion 73 or the half-latch engaging portion 74.

In FIGS. 1 and 2, the electric actuator 3 comprises an opening lever 13 which can turn counterclockwise in a releasing direction for opening the door by a reduction gear for stepping down rotation speed of an electric motor. The lower end of the opening lever 13 is close to or is in contact with a right side of a releasing lever 16 (later described) mounted detachably to the upper end of the pawl shaft 10.

By operating a handle or a switch (not shown) on the door D, the electric actuator 3 is actuated and the opening lever 13 turns counterclockwise or in the releasing direction. The lower end of the opening lever 13 contacts the end of the releasing lever 16. The pawl shaft 10 and the pawl 8 are turned with the releasing lever 16. Thus, the pawl portion 81 of the pawl 8 moves off the full-latch engaging portion 73 of the latch 7, and the door D can be opened.

In FIGS. 1 to 3 and 5, a projection of the pawl shaft 10 projecting upward from the bracket 6 is disposed in an axial hole 141 at the front part of a connecting member 14 and turns in the axial hole 141 so that the connecting member 14 can vertically be inclined with respect to the pawl shaft 10. A rectangular portion 91 is formed at the upper end of the latch shaft 9 projecting upward from the bracket 9 and fits in a rectangular hole 153 of an approximately sector-shaped door-closing half-latch avoiding member 15 for full-latch rotation. The rectangular portion 91 is fixed in the rectangular hole 153 with a screw. The half-latch avoiding member 15 is disposed under part of the connecting member 14. When the latch 7 turns toward the full-latch position from the open position, the door-closing half-latch avoiding member 15 in this embodiment is one of elements for preventing the pawl 8 from engaging with the half-latch engaging portion 74 of the latch 7.

A rectangular portion 101 at the upper end of the pawl shaft 10 fits in a rectangular hole 161 of the releasing lever 16 and is fixed with a screw. Thus, the releasing lever 16 turns together with the pawl 8. The rear end of the releasing lever 16 projects backward from the rear end of the connecting member 14 above the connecting member 14. The rear end of the releasing member 16 is positioned right under the electric actuator 3 and is close to the lower end of the opening lever 13 of the electric actuator 3 as mentioned above. The connecting member 14 and the half-latch avoiding member 15 constitute a half-latch avoiding unit in the present invention.

As described above, the connecting member 14 and the releasing lever 16 are mounted to the pawl shaft 10, and the half-latch avoiding member 15 is mounted to the latch shaft 9. The connecting member 14, the half-latch avoiding member 15 and the releasing member 16 are overlapped thereby making the latch mechanism 3 more compact.

In FIGS. 1, 2 and 5, a circumferential groove 17 is formed on the outer circumferential surface of the pawl shaft 10 between the connecting member 14 and the releasing lever 16. An E-shaped washer 18 fits in the circumferential groove 17 thereby preventing the connecting member 14 from coming out upward. Between the bracket 6 and the connecting member 14, a compression spring 19 is disposed around the pawl shaft 10 by which the connecting member 14 is biased upward normally. Why the connecting member 14 is biased upward by the compression spring 10 is to incline the connecting member 14 by bending the compression spring 19 by the connecting member 14 when a second guide pin 27 (later described) of the connecting member 14 is moved and pushed up along inclined planes of second guide paths 23, 24 (later described) of the half-latch avoiding member 15.

In FIG. 3, an extension spring 20 for biasing the connecting member 14 clockwise is mounted between the right side of the connecting member 14 and the right side of the releasing lever 16 close to the pawl shaft 10.

Figure 6:
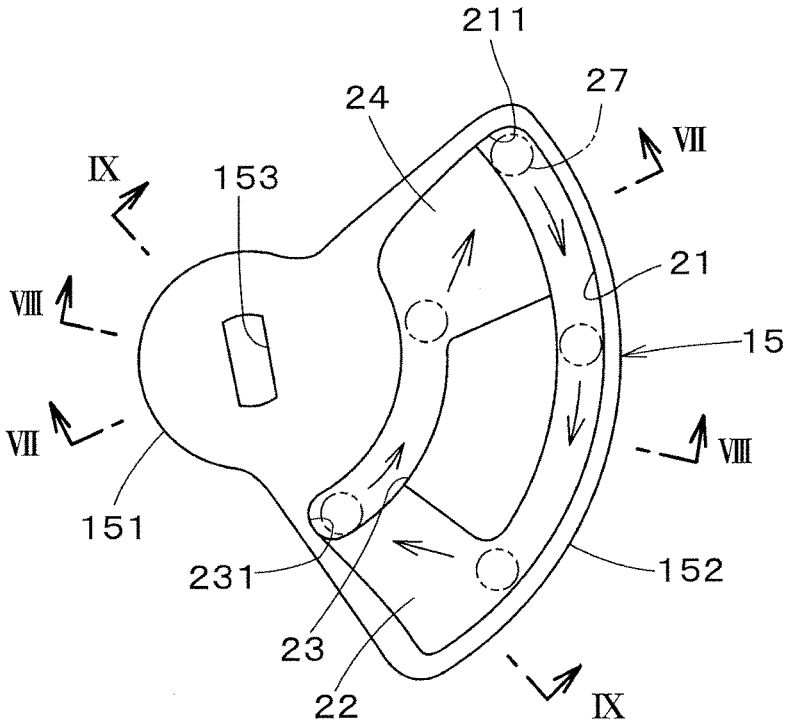
FIG. 6 is an enlarged plan view of a door-opening half-latch avoiding member.

FIGS. 6 to 9 illustrate the door-closing half-latch avoiding member 15 in detail. The left, right, top and bottom in FIG. 6 are deemed as "front", "back", "right" and "left" respectively. The door-closing half-latch avoiding member 15 comprises a semi-circular base 151 and a sector-shaped portion 152 which enlarges from the rear end of the semi-circular base 151 which has a rectangular hole 153 into which the rectangular portion 91 at the upper end of the latch shaft 9 is pressingly fitted. On the upper surface of the sector-shaped portion 152, there is formed an arcuate half-latch avoiding guide path 21 that is an arc around the latch shaft 9 as a center. The details will be described later, and the half-latch avoiding path 21 prevents the latch 7 from being held at the half-latch position and also acts as a guide path for guiding a second guide pin 27.

On the upper surface of a left part of the sector-shaped portion 152, there is formed a first wide guide path 22 which communicates continuously with the half-latch avoiding guide path 21 perpendicular to a rotational direction of the door-closing half-latch avoiding member 15.

On the upper surface of the sector-shaped portion 152 close to the base 151, there is formed a second arcuate guide path 23 which communicates with the first guide path 22 at the left side edge. The second guide path 23 is an arc around the latch shaft 9 as a center. On the upper surface of the right part of the sector-shaped portion 152. There is formed a third wide guide path 24 which communicates with the half-latch avoiding guide path 21 and continuously with the second guide path 23, perpendicular to the rotational direction of the the door-closing half-latch avoiding member 15.

Figure 7:
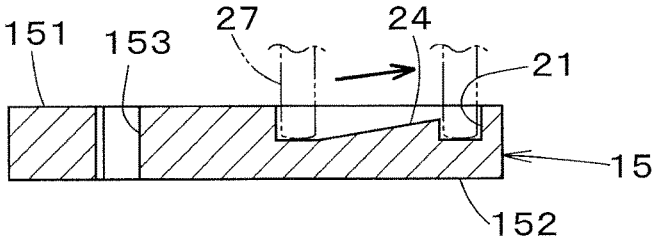
FIG. 7 is a vertical sectional side view taken along the line VII-VII in FIG. 6.
Figure 8:
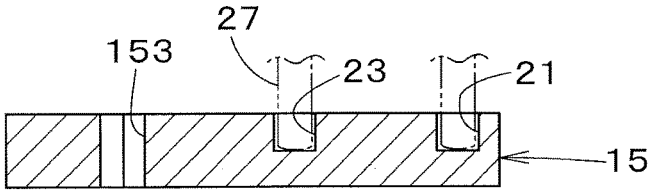
FIG. 8 is a vertical sectional side view taken along the line VIII-VIII in FIG. 6.
Figure 9:
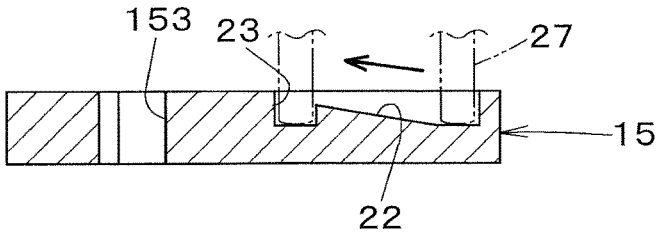
FIG. 9 is a vertical sectional side view taken along the lire IX-IX in FIG. 6.

In FIG. 7, the third guide path 24 is gently inclined upward from the bottom of the second guide path 23 to the half-latch guide path 21. In FIG. 9, the first guide path 22 is gently inclined upward from the bottom of the half-latch avoiding guide path 21 to the second guide path 23. The first guide path 22 and the third guide path 24 are inclined upward oppositely to each other and communicate with the half-latch avoiding guide path 21 and second guide path 23, thereby reducing depth of the half-latch avoiding guide path 21 and second guide path 23 and also reducing thickness of the door-closing half-latch avoiding member 15. Thus, the second guide pin 27 (later described) can smoothly be moved toward the half-latch avoiding guide path 21 and second guide path 23.

The half-latch avoiding guide path 21 and the first, second and third guide paths 22,23,24 form a continuous loop-like guide path. As the door-closing half-latch avoiding member 15 turns with the latch 7 from the open position to the open position again via the full-latch position, the second guide pin 27 returns to a beginning 211 of the half-latch avoiding guide path 21 from the beginning 211 via the first guide path 22, a beginning 231 of the second guide path 23 and the third guide path 24. Accordingly, the latch 7 turns smoothly from the open position to the open position again via the half-latch position and the full-latch position.

In FIGS. 3 and 5, in the middle of the connecting member 14, an elongate opening 25 which is an arc around the pawl shaft 10 is formed from the left part to the center. In the elongate opening 25, the lower end of a first guide pin 26 the upper end of which is fixed to a hole on the releasing lever 16 is disposed to move therein. The connecting member 14 is mounted to the pawl shaft 10 and moves with the pawl 8.

The first guide pin 26 moves along the elongate opening 25, and the connecting member 14 moves with respect to the releasing lever 16. The first guide pin 26 contacts the right end of the elongate opening 25. Hence, the connecting member 14 turns together with the releasing lever 16 and pawl 8 toward the latch 7 to enable the pawl 8 to engage with the full-latch engaging portion 73. The first guide pin 26 moves toward the left end of the elongate opening 25 to enable the pawl 8 to disengage from the full-latch engaging portion 73.

The upper end of the second guide pin 27 is fixed in a hole at the rear corner of the connecting member 14, and the lower end of the second guide pin 27 is positioned at the beginning 231 of the second guide path 23 in the door-closing half-latch avoiding member 15 when the door D is fully open by turning the latch 7 to the full-latch position in FIG. 3.

With respect to FIG. 10A to 10H, motion of the first embodiment of the door latch device 1, particularly motion of each member when the door is opened and closed, will be described. In the following description, as well as the above, the left-side, right side, top and bottom in each figure are deemed "front", "back", "right" and "left" respectively.

Figures 10A, 10B, 10C, 10D, 10E, 10F, 10G, 10H:
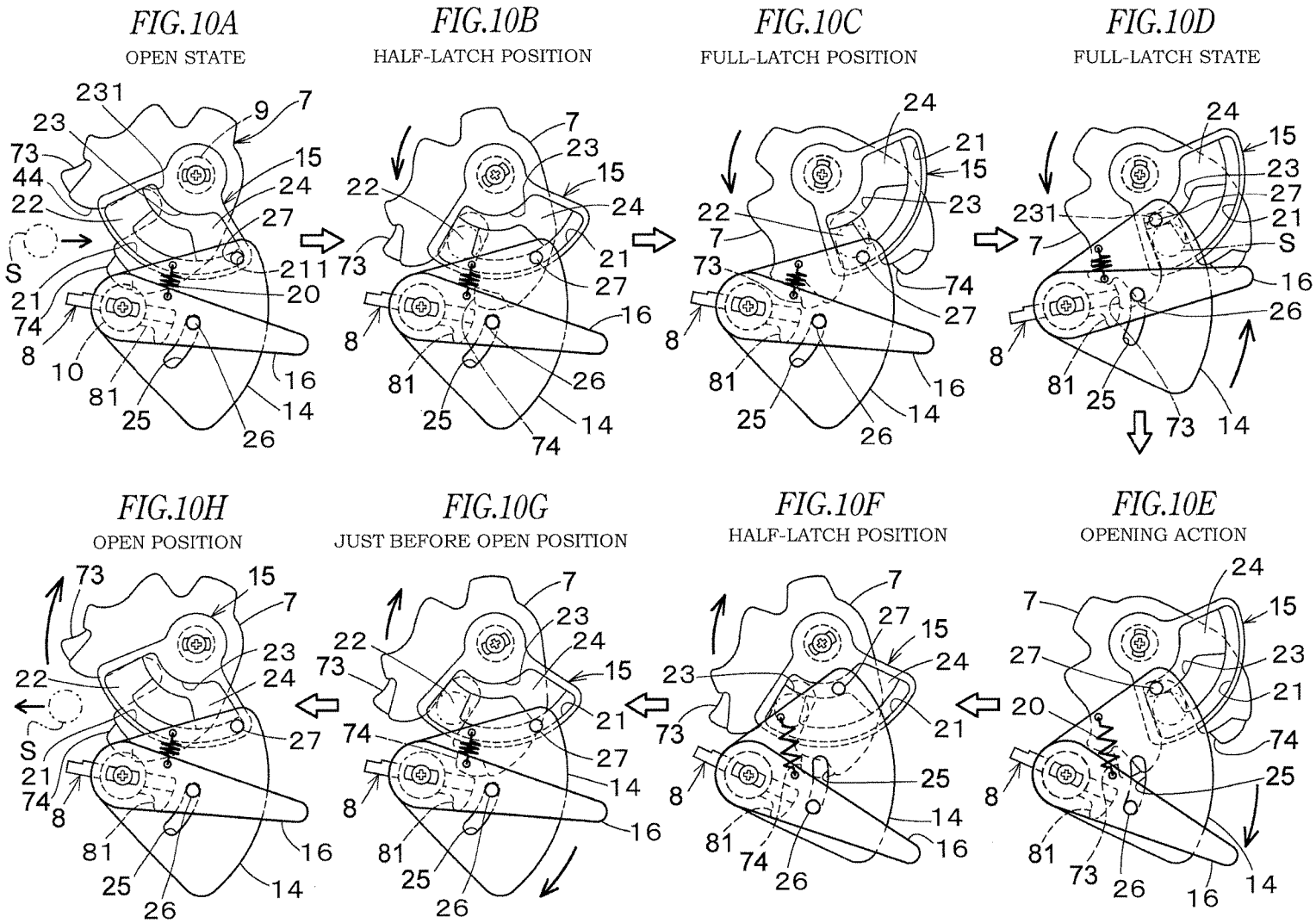
FIGS. 10A to 10H are plan views illustrating motion of the latch mechanism in order when the door is opened and closed.

FIG. 10A illustrates an open state where the door is open or where the latch 7 disengages from the striker S by disengaging the pawl portion 81 of the pawl 8 from the latch 7. The first guide pin 26 of the releasing lever 16 is positioned at the right end of the elongate opening 25 of the connecting member 14, and the second guide pin 27 of the connecting member 14 is positioned at the beginning 211 of the half-latch avoiding guide path 21 of the door-closing half-latch avoiding member 15. In the open state in FIG. 10A, the pawl 8, the releasing lever 16 that turns with the pawl 8 and the connecting member 14 are prevented from turning counterclockwise.

When the door is closed at the open state in FIG. 10A, the striker S moves into the engagement groove 44, the latch 7 and the door-closing half-latch avoiding member 15 are turned together counterclockwise to the full-latch position in which the door is fully closed in FIG. 10C via the half-latch position in which the door is incompletely closed in FIG. 10B.

With turning of the door-closing half-latch avoiding member 15, the second guide pin 27 of the connecting member 14 is guided along the half-latch avoiding guide path 21 to relatively move from the beginning 211 toward the first guide path 22. While the second guide pin 27 is guided along the half-latch avoiding guide path 21 or while the latch 7 turns right before the full-latch position beyond the half-latch position, the pawl 8, releasing lever 16 and connecting member 14 are prevented from turning counterclockwise.

The latch 7 and door-closing half-latch avoiding member 15 turns to the full-latch position in FIG. 10C, and the second guide pin 27 moves off the left end of the half-latch avoiding guide path 21, enabling the second guide pin 27 to move toward the second guide path 23 along the first guide path 22. The pawl 8 and releasing lever 16 are biased counterclockwise by the torsion spring 12, and the connecting member 14 is biased counterclockwise via the first guide pin 26 of the releasing lever 16. The second guide pin 27 moves off the end of the half-latch avoiding guide path 21, and moves toward the second guide path 23 while the second guide pin 27 is slightly pushed up along the first guide path 22 to the beginning 231. The second guide pin 27 moves along the second guide path 23 FIG. 9. In FIG. 10D, the pawl 8, releasing lever 16 and connecting member 14 turn together counterclockwise, and the pawl portion 81 of the pawl 8 engages with the full-latch engaging portion 73, so that the latch 7 is held in the full-latch state and the door is fully closed.

As described in the background of the invention, in the prior art, when the door is closed, the pawl portion 81 of the pawl 8 can engage with the half-latch engaging portion 74 of the latch 7 in a half-closed state without turning the latch 7 to a full-latch position for holding the door fully open due to repulsion of a weatherstrip.

However, in the door latch device in this embodiment, as mentioned above, while the second guide pin 27 moves along the half-latch avoiding guide path 21 or while the latch 7 turns to a position just before the full-latch position beyond the half-latch position, the connecting member 14, releasing lever 16 and pawl 8 are prevented from turning counterclockwise. Thus, in FIG. 100, the pawl portion 81 of the pawl 8 moves off a rotation track of the half-latch engaging portion 74 of the latch 7, and is held in a released position where the pawl portion 81 of the pawl 8 cannot engage with the half-latch engaging portion 74, in the half-latch position. Hence, when the door is closed, the latch 7 is not held in the half-latch position, and the pawl portion 81 of the pawl 8 engages with the full-latch engaging portion 73 of the latch 7 in FIGS. 10C and 10D beyond the half-latch position. Thus, the door can be held in the fully-closed position by a single closing action.

The half-latch avoiding guide path 21 has a concave cross-section and the second guide pin 27 moves along the half-latch avoiding guide path 21. The second guide pin 27 is unlikely to go off the half-latch avoiding guide path 21, and the latch 7 is securely prevented from being held in the half-latch position.

In the full-latch state in FIG. 10D, as mentioned above, by operating a handle or a switch on the door, the electric actuator 8 is actuated and the opening lever 13 turns in the releasing direction. In FIG. 10E, the releasing lever 16 and pawl 8 that move with the opening lever 13 are turned together clockwise. Thus, the pawl portion 81 of the pawl 8 disengages from the full-latch engaging portion 73 of the latch 7, and the latch 7 turns clockwise to the open position in FIG, 10H via the half-latch position in FIG. 10F, so that the striker S is released from the striker-fitting groove 44 and the door can be opened.

In an opening operation in FIG. 10E, the first guide pin 26 is guided along the elongate opening 25 to the left end, and the connecting member 14 does not turn. Thus, the second guide pin 27 of the connecting member 14 remains in the second guide path 23. With turning of the latch 7 to the half-latch position in FIG. 10F, the second guide pin 27 is guided along the second guide path 23 to the third guide path 24.

The latch 7 turns clockwise beyond the half-latch position, and the second guide pin 27 leaves the right end of the second guide path 22. In FIG. 10G, the second guide pin 27 moves into the third guide path 24, and at the same time, the connecting member 14 turns clockwise by a force of the torsion spring 20. Thus, the second guide pin 27 moves into the half-latch avoiding guide path 21, and the latch 7 turns clockwise to the open position in FIG. 10H or open state in FIG. 10A while preventing the connecting member 14 and releasing member 16 from turning counterclockwise.

As described above, in the door latch device in the first embodiment, when the door is closed, the second guide pin 27 of the connecting member 14 is guided along the half-latch avoiding guide path 21 to prevent the connecting member 14, releasing member 16 and pawl 8 from turning toward the latch 7. Thus, the pawl portion 81 of the pawl 8 does not engage from the half-latch engaging portion 74 of the latch 7.

When the door is closed, the latch 7 is not held in the half-latch position, and the pawl portion 81 of the pawl 8 engages with the full-latch engaging portion 73 of the latch 7 beyond the half-latch position. Hence, the door is not held in the half-door state, and is fully closed by a single closing action securely, thereby solving trouble that the incompletely-closed door is opened and closed again.

The second embodiment of a door latch device according to the present invention will be described. The door-closing half-latch avoiding member 15 is replaced with a door-opening half-latch avoiding member 300 by which a latch is not held in a half-latch position when the door is opened. The door-opening half-latch avoiding member 300 in this embodiment is one of elements for disengaging the pawl 8 from the half-latch engaging portion 74 of the latch 7 when the latch 7 turns toward an open position from a full-latch position.

The door-closing half-latch avoiding member 15 in the first embodiment is detachably attached to the upper end of the latch shaft 9, and can easily be replaced with the door-opening half-latch avoiding member 300. How to differ from the first embodiment is only the shape of the door-opening half-latch avoiding member 300, and detailed description will be omitted with respect to the other members similar to those in the first embodiment.

In FIGS. 11 to 14, the door-opening half-latch avoiding member 300 in the second embodiment has the same shape in a top plan view as the door-closing half-latch avoiding member 15, and has a base 301 having a rectangular hole 303 and a sector-shaped portion 302. On the upper surface of the sector-shaped portion 302, there are formed a half-latch avoiding guide path 304 which is an arc around a latch shaft 9 as a center; a first wide guide path 305; a second guide path 306 which is an arc around the latch shaft 9 as a center; and a third wide guide path 307 to form a continuous loop-like guide path as well as the door-closing half-latch avoiding member 15.

Figure 12:
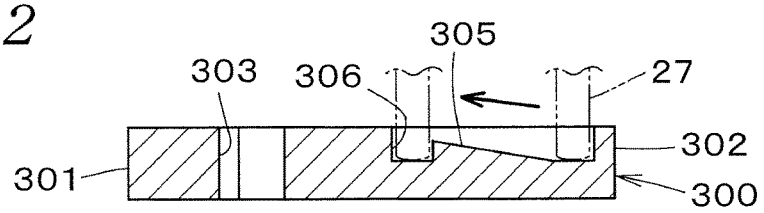
FIG. 12 is a vertical sectional view taken along the line XII-XII in FIG. 11.
Figure 13:
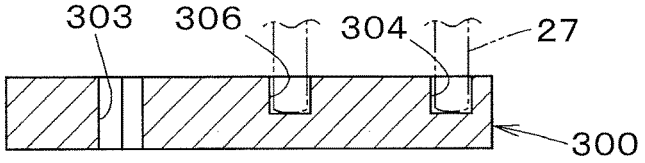
FIG. 13 is a vertical sectional view taken along the line XIII-XIII in FIG. 11.

Unlike the door-closing half-latch avoiding member 15, the right end (upper part of FIG. 10) of the half-latch avoiding guide path 304 and the left end of the second guide path 306 are open. In FIG. 12, the first guide path 305 is gently inclined upward from the bottom of the half-latch avoiding guide path 304 toward the second guide path 306.

Figure 14:
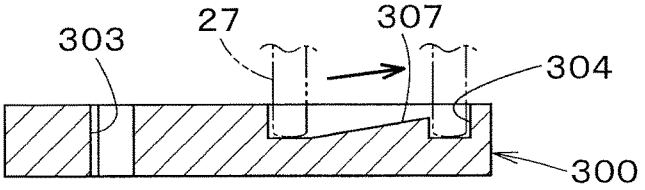
FIG. 14 is a vertical sectional view taken along the line XIV-XIV in FIG. 11.

In FIG. 14, the third guide path 307 is gently inclined upward from the bottom of the second guide path 306 toward the half-latch avoiding guide path 304.

Figure 11:
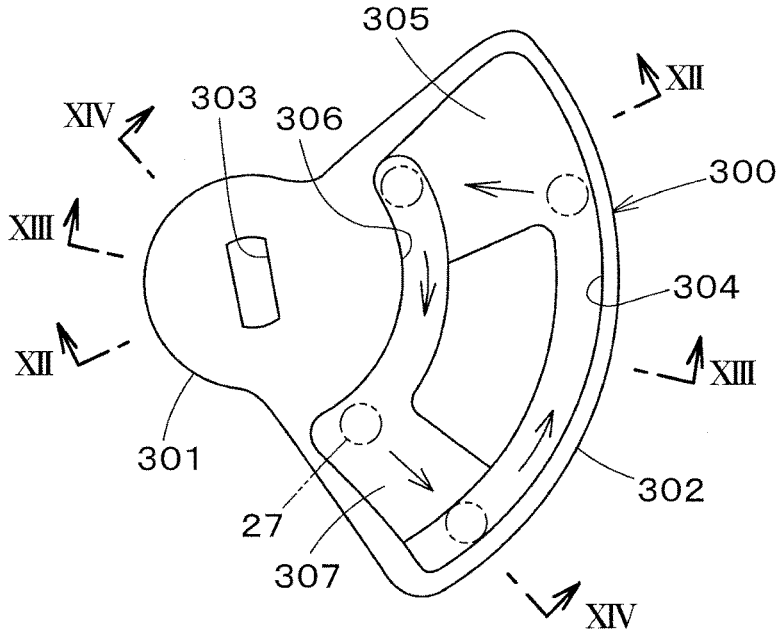
FIG. 11 is an enlarged plan view of a half-latch avoiding member for a door latch device to prevent the latch from being held in a half-latch position when the door is opened.

In FIG. 15, as the door-opening half-latch avoiding member 300 turns with the latch 7 between a full-latch position and an open position, a second guide pin 27 of a connecting member 14 moves in a direction opposite to the first embodiment along the half-latch avoiding guide path 304, first guide path 305, second guide path 306 and third guide path 307 as shown by arrows in FIG. 11.

With respect to FIGS. 15A to 15D, the door latch device 1 in the second embodiment will be described, particularly on motion of each member when the door is opened. In the following description, the left, right, top and bottom are defined as "front", "rear" and "left".

Figure 15A:
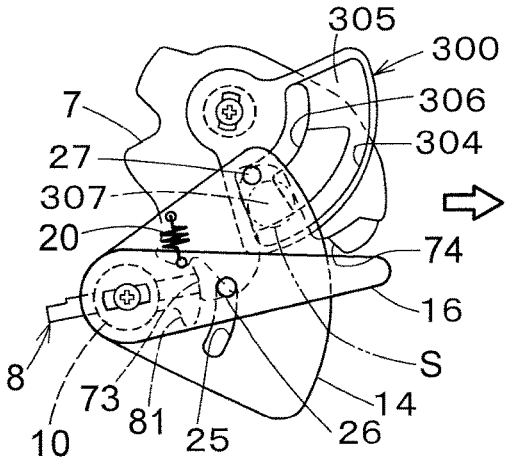
FIGS. 15A to 15D are plan views illustrating motion of each member of a latch mechanism in order when the door is opened.

FIG. 15A illustrates a full-latch state where the pawl portion 81 of the pawl 8 engages with the full-latch engaging portion 73 of the latch 7. The first guide pin 26 is positioned at the upper or right end of the elongate opening 25, and the second guide pin 27 is positioned at an open part of the second guide path 306 meeting the third guide path 307 thereby preventing the connecting member 14, releasing lever 16 and pawl 8 from turning counterclockwise.

Figure 15B:
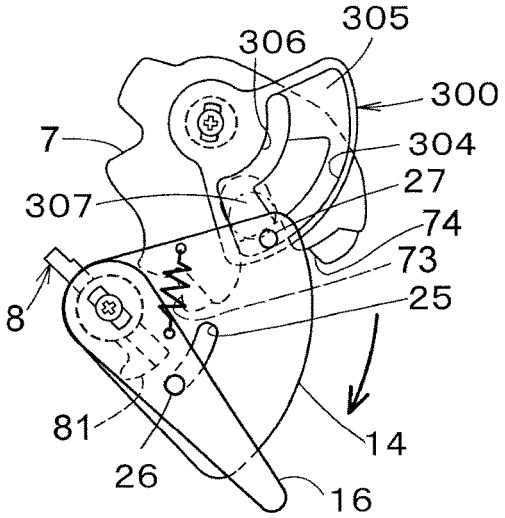

In FIG. 15A, as well as the first embodiment, the electric actuator 3 is actuated, and the releasing lever 16 which contacts the opening lever 13 is turned clockwise or in a releasing direction. In FIG. 15B, the first guide pin 26 of the releasing lever 16 moves and contacts the lower or left end of the elongate opening 25, and the pawl portion 81 of the pawl 8 disengages from the full-latch engaging portion 73 enabling the latch 7 to turn clockwise or in a door-opening direction. At the same time, the second guide pin 27 moves to the left end of the half-latch avoiding guide path 304 along the third guide path 307.

Figure 15D:
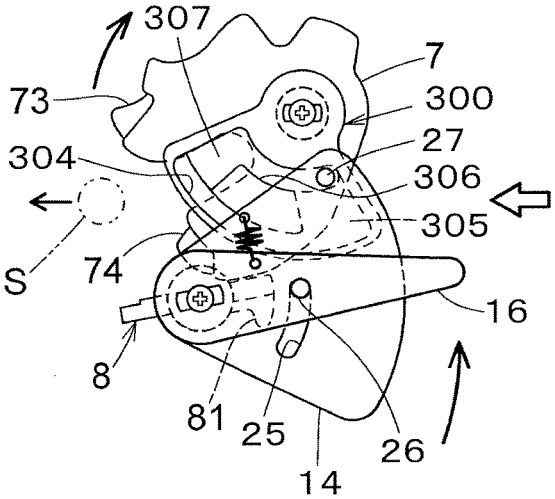
Figure 15C:
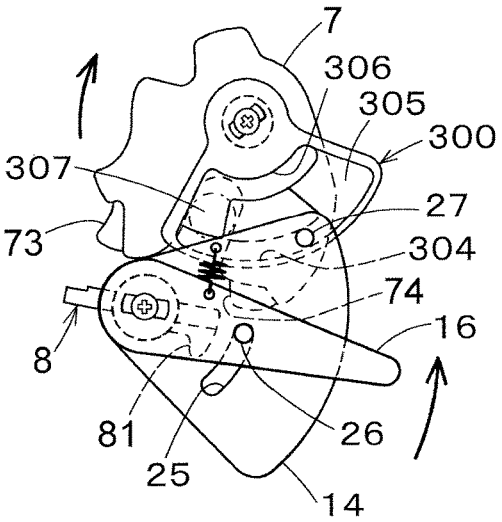

The latch 7 turns clockwise, and in FIG. 15C, the second guide pin 27 of the connecting member 14 is guided along the half-latch avoiding guide path 304 toward the first guide path 305. Hence, while the second guide pin 27 moves along the half-latch avoiding guide path 304, or while the latch 7 turns to a position just before the open position beyond the half-latch position, the connecting member 14, releasing lever 16 and pawl 8 are prevented from turning counterclockwise. In a half-latch position in FIG. 15C, the pawl position 81 of the pawl 8 is positioned at a disengaging position outside a turning track of the half-latch engaging portion 74. Thus, when the door is opened, the latch 7 is not held in the half-latch position even if the door is not sufficiently raised due to decrease in repulsion of a weatherstrip. The door can smoothly be opened by a single opening action.

When the door is closed in the open position in FIG. 15D, the second guide pin 27 relatively moves to FIG. 15A along the second guide path 306. When the door is closed in the open position in FIG. 15D, the first guide pin 26 moves to the lower or left end of the elongate opening 25, the pawl 8 and releasing lever 16 which is in sliding contact with the outer circumferential surface of the latch 7 are allowed to turn clockwise, and the pawl 8 can engage with the full-latch engaging portion 73 or half-latch engaging portion 74 without problem.

In the second embodiment of the door latch device, the door-closing half-latch avoiding member 15 in the door latch device in the first embodiment is only replaced with the door-opening half-latch avoiding member 300 while the other members are still kept, thereby easily converting it to a door latch device for preventing the latch 7 from being held in the half-latch position when the door is opened.

Specifically, by attaching the door-closing half-latch avoiding member 15 and the door-opening half-latch avoiding member 300 selectively while the other parts are common to the two members, two types of door latch devices can be provided, such as a door latch device in which the latch 7 is prevented from being held in the half-latch position when the door is closed and a door latch device in which the latch 7 is prevented from being held in the half-latch position when the door is opened. Furthermore, the door-closing half-latch avoiding member 15 and door-opening half-latch avoiding member 300 are detachably attached to the latch shaft 9, and the connecting member 14 is detachably attached to the pawl shaft 10 thereby facilitating the door-closing half-latch avoiding member 15 and door-opening half-latch avoiding member 300 to be attached and replaced. It is not necessary to apply special machining to the latch 7 and pawl 8 or to modify the shapes and positions.

The present invention is described with respect to the foregoing embodiments, and the following changes and modifications may be made without departing from the scope of claims.

In the first and second embodiments, the half-latch avoiding guide paths 21,304 for preventing the latch 7 from being held in the half-latch position have a concave cross-section, and may have an upward arcuate projection. The second guide paths 23,305 for guiding the second guide pin 27 may have an upward arcuate projection.

In the first and second embodiments, the connecting member 14, door-closing half-latch avoiding member 15, door-opening half-latch avoiding member 300 and releasing lever 16 are overlapped in order from below, but its order may be changed. The first and second guide pins 26,27 may project upward and downward respectively, and the half-latch avoiding guide paths 21,304 and each guide path may be formed on the lower surface of the door-closing half-latch avoiding member 15 or door-opening half-latch avoiding member 300.

In the first and second embodiments, the pawl 8 is used to engage with the full-latch engaging portion 73 and half-latch engaging portion 74, but a flat ratchet may be used. The ratchet turns with the opening lever 13 of the electric actuator 3. The connecting member 14 is attached to a shaft of the ratchet with a certain play in a turning direction with respect to the ratchet. Thus, it is not necessary to provide the releasing lever 16.

In the first and second embodiments, the releasing lever 16 is turned by the electric actuator 3, but the release lever 16 is manually turned with a cable connected at one end to the releasing lever 16 and at the other end to a door-opening lever in the vehicle body.

The connecting lever 14, door-closing half-latch avoiding member 15 or door-opening half-latch avoiding member 300 and releasing lever 16 may be covered with another cover member. A large space is formed between the base member 4 and cover member 5. The connecting lever 14, door-closing half-latch avoiding member 15 or door-opening half-latch avoiding member 300 and releasing lever 16 may be disposed in the space.

The door-closing half-latch avoiding member 15 and door-opening half-latch avoiding member 300 may be molded with resin mold of the latch 7.

In the second embodiment, in order to allow turning of the pawl 8 which is in sliding contact with the outer circumferential surface of the latch 7 when the door is closed, the elongate opening 25 is formed in the connecting member 14 and the connecting member 14 moves with the pawl with a play. The elongate opening 15 may be omitted and the play may be lost. The width of the third guide path 306 may be large, and the second guide pin 27 may be moved in a direction of the width when the door is closed.

The present invention may be applied to a side door or a sliding door of a motor vehicle other than the liftgate.

What is claimed is:

1. A motor-vehicle door latch device comprising:

a latch shaft;

a latch pivotally mounted on the latch shaft and comprising a full-latch engaging portion and a half-latch engaging portion, the latch being capable of engaging a striker of a vehicle body;

an engagement-member shaft;

an engagement member pivotally mounted to the engagement-member shaft, the engagement member being capable of engaging the full-latch engaging portion of the latch to fully engage the latch with the striker and of engaging the half-latch engaging portion of the latch to incompletely engage the latch with the striker;

a half-latch avoiding member fixed to the latch shaft and turning with the latch, the half-latch avoiding member having a half latch avoiding guide path, a first guide path that communicates with the half-latch avoiding guide path, a second guide path that communicates with the first guide path and a third guide path that communicates with the second guide path and the half-latch avoiding guide path to form a loop, the first guide path being gently inclined upward from the half-latch avoiding guide path to the second guide path, the third guide path being gently inclined upward from the second guide path to the half latch avoiding guide path;

a releasing member pivotally mounted to the engagement-member shaft and rotating with the engagement member; and a connecting member that is pivotally mounted to the engagement-member shaft and has a guide pin that engages in and slides along the loop of the half latch avoiding guide path and the first the second and the third guide paths of the half-latch avoiding member, wherein the guide pin of the connecting member engages in the half-latch avoiding guide path not to engage the half-latch portion of the latch with the engagement member.

2. The motor-vehicle door latch device of claim 1 wherein the engagement member comprises a pawl having a pawl portion which engages with the latch.

3. The motor-vehicle door latch device of claim 1 wherein the engagement member comprises a ratchet which engages with the latch.

4. The motor-vehicle door latch device of claim 1 wherein the half-latch avoiding member prevents the engagement member from engaging with the half-latch engaging portion of the latch when the door is closed.

5. The motor-vehicle door latch device of claim 1 wherein the half-latch avoiding member prevents the engagement member from engaging with the half-latch engaging portion of the latch when the door is opened, the guide pin relatively moving in a direction opposite to a direction of movement when the door is closed.

* * * * *